United States Patent [19]

Brandt, III

[11] Patent Number: 4,530,511

[45] Date of Patent: Jul. 23, 1985

[54] SEPARABLE SKI

[76] Inventor: Walter A. Brandt, III, 2101 Redwood Ave., Emporia, Kans. 66801

[21] Appl. No.: 544,685

[22] Filed: Oct. 24, 1983

[51] Int. Cl.[3] ..... A63C 5/02

[52] U.S. Cl. ..... 280/603; 403/364

[58] Field of Search ..... 280/603; 403/322, 331, 403/364, 377, 339, 340, 341

[56] References Cited

U.S. PATENT DOCUMENTS

| | | | |
|---|---|---|---|
| 715,110 | 12/1902 | Miller | 403/364 |
| 3,104,888 | 9/1963 | Day | 280/603 |
| 3,596,918 | 8/1971 | Masuda | 403/341 |
| 4,155,568 | 5/1979 | Galich | 280/603 |

*Primary Examiner*—David M. Mitchell
*Assistant Examiner*—Richard M. Camby
*Attorney, Agent, or Firm*—Kokjer, Kircher, Bradley, Wharton, Bowman & Johnson

[57] ABSTRACT

A separable ski with an interconnecting joint having no snow contacting surface. The joint includes a female connector having an internally grooved socket which receives the tongue of a male connector. An overcenter cam toggle lock carried on the male connector engages a latch hook on the female connector and resides within the dimensions of the ski to securely lock together the separable portions of the ski.

9 Claims, 6 Drawing Figures

SEPARABLE SKI

BACKGROUND AND SUMMARY OF THE INVENTION

This invention relates to a ski construction. More particularly, the invention relates to a separable ski which may be divided intermediate the length thereof for separation into head and tail portions for storage or transport, but which may be located together to provide a unitary construction for conventional use while skiing.

Because of their length, conventional skis are unwieldly and troublesome to transport. The typical scene at winter resort areas characteristically shows skis transported atop vehicles on carrier racks. The skis are thus exposed to the weather and to potential vandals or thieves, since the skis normally cannot be placed inside the vehicle.

Difficulty in physically carrying skis is also encountered in public places such as airports and hotels. Assuming that physical obstacles of the environs can be successfully avoided, lengthy skis represent a potential hazard to passersby when carried by an inattentive skier.

In view of the foregoing problems associated with conventional skis, efforts have heretofore been devoted to separable or folded ski constructions to allow the skis to be more readily stored or transported. However, prior attempts to provide a two piece ski have enjoyed only limited success due to numerous drawbacks affecting the conventional use and performance of the ski.

For example, numerous connections have been proposed for joining the head and tail portions of a separable or folded ski. Some of these constructions employ a removable retaining member which is subject to being misplaced or lost when the ski is collapsed. Under such circumstances, a ski trip could be ruined for the skier who is unable to secure a replacement part in order to lock the skis together for use. Examples of prior patents which show a removable connecting member include U.S. Pat. Nos. 3,439,928 of Noguchi; 3,689,093 of Meland; 3,819,198 of Groves; 3,825,360 of Galich; 4,155,568 of Galich; and 4,262,924 of Corwin.

A special implement or tool is necessary in the assembly of the ski shown in U.S. Pat. Nos. 3,439,928 of Noguchi; 3,819,198 of Groves; 3,825,360 of Galich; and 4,155,568 of Galich. Although conceivably tightenable by hand, a wrench or pair of pliers may be necessary to insure proper adjustment for the skis disclosed in U.S. Pat. Nos. 2,224,897 of Burton et al; 2,450,538 of Beaudin; 3,689,093 of Meland; 4,248,449 of Wilhelmy; and 4,262,924 of Corwin. In any event, a special implement or tightening tool is subject to being misplaced or lost just as is any removable piece of the ski itself.

With respect to the locking or latching mechanism used in two-piece prior art skis, most are exposed and project from the usual contour of the ski. Two problems are present with this feature. When in use, snow and ice tend to build up around an exposed latch rendering the mechanism either useless or difficult to operate if the ski is to be separated temporarily. More significantly, the exposed latch may be subject to accidental disconnection when the skier contacts an obstacle or falls. This represents a safety consideration to the design of the separable ski. Prior art skis illustrating exposed latching mechanisms are found in U.S. Pat. Nos. 2,224,897 of Burton et al; 2,450,538 of Beaudin; 2,791,435 of Meland; 3,689,093 of Meland; 4,125,273 of Rothmayer; 4,248,449 of Wilhelmy; and 4,262,924 of Corwin.

In order to maintain sufficient structural integrity, many two piece ski constructions utilize a connection having an extended support surface in contact with the snow during skiing activity. The connection mechanism is almost universally constructed of metal, for sufficient strength and rigidity, and is dissimilar from the usual snow engaging surfaces of a normal ski. Thus, depending upon the skiing conditions encountered, the connection surfaces in contact with the snow can greatly affect the performance of the ski. U.S. patents illustrative of this drawback include U.S. Pat. Nos. 2,450,538 of Beaudin; 2,791,453 of Meland; 3,439,928 of Noguchi; 3,689,093 of Meland; 3,825,360 of Galich; 4,155,568 of Galich; 4,248,449 of Wilhelmy; and 4,262,924 of Corwin.

Lastly, of the two-piece prior art skis of which I am aware as previously discussed, all utilize a single bond of either adhesive, friction or mechanical feature in joining the connection mechanism with the conventional materials of ski construction.

The need therefore exists in the ski industry for a separable, two piece ski which overcomes the use and performance deficiencies found in the prior art devices. The primary goal of this invention is to fulfil this need.

Another object of the invention is to provide a separable ski having a fully contained interlocking mechanism requiring no removable parts for separation of the ski portions.

Another object of the invention is to provide a separable ski of the character described which may be fully assembled or disassembled with the hands. Thus, the need for a tool or special implement is not required in either assembling the two portions of the ski or the disassembly thereof.

An additional object of the invention is to provide a separable ski of the character described which cannot be accidentally separated. The joint provided for interconnecting the ski portions is fully contained within the conventional dimensions of the ski itself and, when the ski is used in skiing activities, the joint has no exposed features to be accidentally bumped or disconnected.

A further object of the invention is to provide a separable ski matching the performance characteristics of a conventional ski. As a corollary, the separable ski is of an extremely rugged and durable construction having superior integrity with no discontinuity of snow contacting materials.

Other and further objects of the invention, together with the features of novelty appurtenant thereto, will appear in the course of the following description of the drawings.

DESCRIPTION OF THE DRAWINGS

In the accompanying drawings, which form a part of the specification and are to be read in conjunction therewith, and in which like reference numerals are employed to indicate like parts in the various views:

Referring to the drawings in greater detail, FIG. 1 illustrates a conventional downhill ski which has been divided intermediate the ends thereof to provide a separable ski in accordance with a preferred embodiment of the invention.

Figure 1:
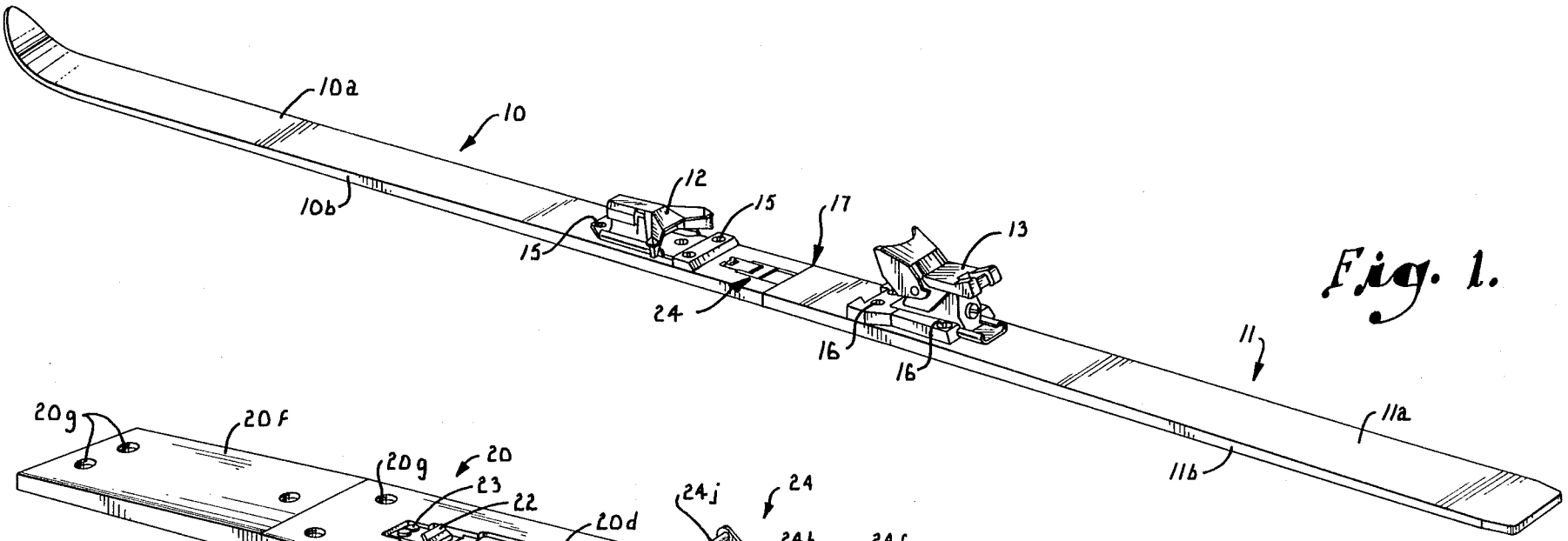
FIG. 1 is a perspective view of a downhill ski constructed in accordance with a preferred embodiment of the invention.
Figure 4:
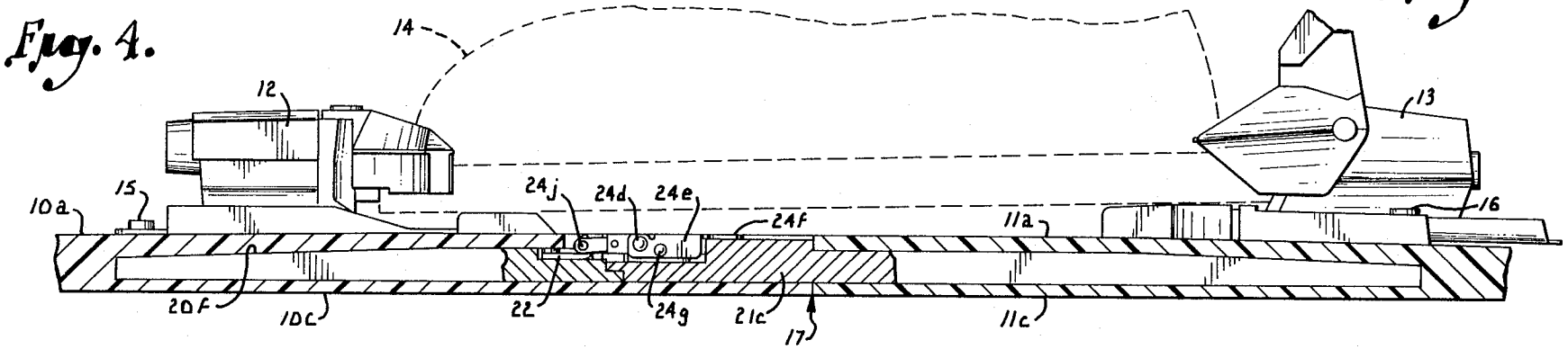
FIG. 4 is a side elevational view taken along line 4—4 of FIG. 3 in the direction of the arrows.
Figure 6:
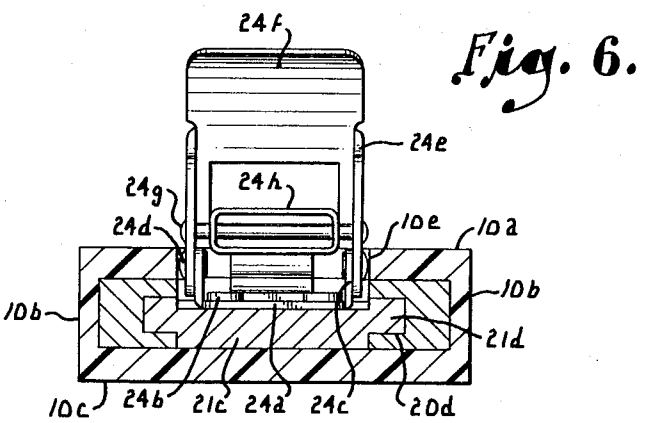
FIG. 6 is an end elevational view along line 6—6 of FIG. 5 in the direction of the arrows.

The ski includes a head portion 10 and a tail portion 11 each having upper surfaces 10*a* and 11*a*, side edges 10*b* and 11*b*, and lowering, snow contacting surfaces 10*c* and 11*c*. Mounted on the upper surfaces 10*a* and 11*a* of the ski are ski bindings 12 and 13 adapted to adjustably receive a conventional ski boot 14. The ski bindings include a toe piece boot binder 12 mounted on the head portion 10 of the ski by means of screws or bolts 15 and a heel binder 13 similarly mounted on the tail portion 11 of the ski by means of screws or bolts 16. As will be readily apparent to any skier, the ski bindings illustrated are of a conventional design whereby the skier inserts the toe of the ski boot 14 into the toe piece 12 and then steps down with the heel to engage the cocked heel binder 13 which yieldingly clamps the ski boot 14 to the ski (FIG. 4). For the purpose of the present invention, it should be noted that the separable ski is divided into two pieces between the toe piece 12 and heel binder 13 as indicated in FIG. 1 by the reference arrow.

Figure 2:
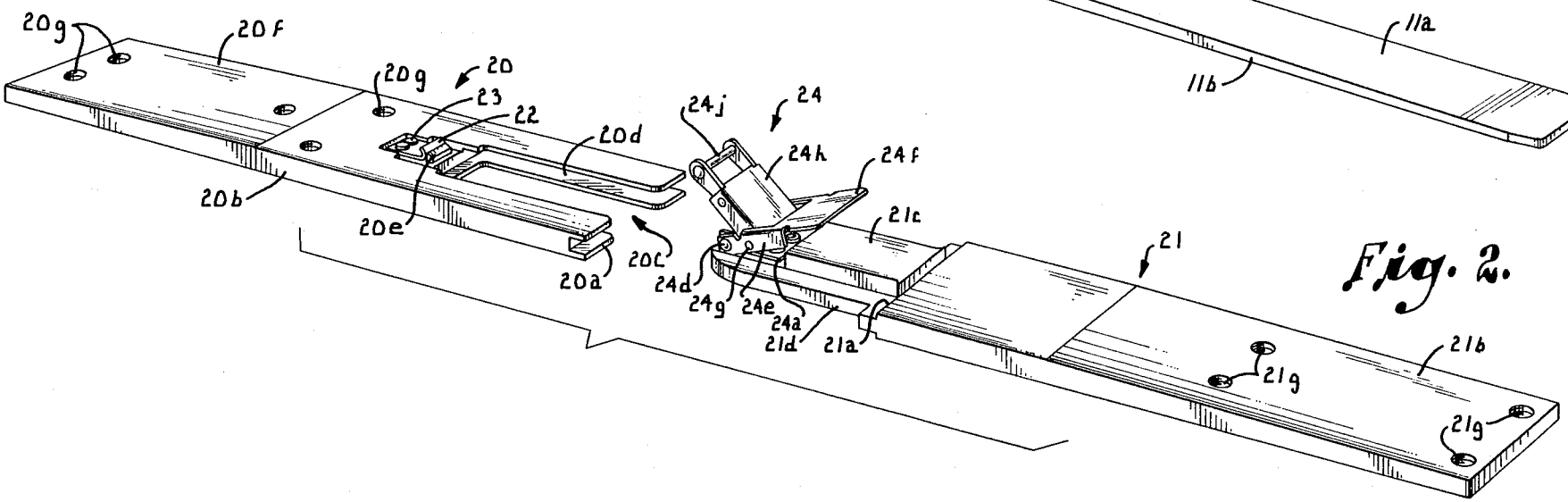
FIG. 2 is an exploded perspective view of the connection joint adapted for a separable ski.

Separation or locking assemblage of the head and tail portions 10 and 11 of the separable ski is provided by an interconnecting joint now to be described in detail. With reference to FIG. 2, the interconnecting joint includes a female connector 20 and a male connector 21.

Figure 3:
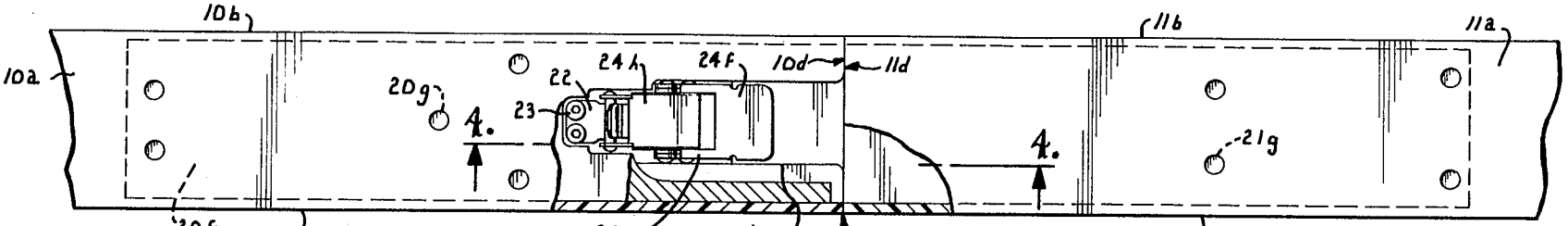
FIG. 3 is a fragmentary, top plan view of the ski with portions thereof broken away to better illustrate the details thereof.

The female connector 20 is fabricated of substantially flat stock material, preferably metal, for embedment within the ski. The forward end of the female connector includes an abutment end, indicated by the numeral 20*a*, which coterminates with the abutment end 10*d* of the head portion 10 as illustrated in FIG. 3. Inwardly of the side edges 20*b* of the female connector 20 and adjacent the abutment end 20*a*, a socket 20*c* is formed. The sidewalls of the socket 20*c* and the abutment end 20*a* of the female connector are grooved to provide a continuous channel 20*d*.

Mounted centrally on the upper surface of the female connector 20 and adjacent the socket 20*c* thereof is a latch hook 22 which is securely mounted by threaded connectors 23. An upstanding boss 20*e* is formed in the upper surface of the female connector 20 in front of the latch hook 22 for location and reinforcement of the latch hook 22.

The rearward end of the female connector 20 includes a taper 20*f*, as illustrated in FIGS. 2 and 4, to follow the conventional contours of a downhill ski which may vary in thickness throughout its length but which is generally characterized as uniformly progressing from a relatively thin section at the ski tip to a thicker section on which the bindings are mounted to a relatively thin section at the tail of the ski.

The female connector 20 may also be provided with threaded holes 20*g* registering with the screw or bolt members 15 used to mount the toe piece boot binder 12 to the ski portion 10.

Constructed as previously described, the female connector 20 is embedded in the head portion 10 of the ski with the abutment end 20*a* of the female connector registering with the end 10*d* of the head portion 10. The upper surface 10*a* of the head portion 10 is notched to provide an opening 10*e* which substantially overlies the socket 20*c* of the female connector 20 and permits access from above to the latch hook 22. Otherwise, the female connector 20 is encased within the conventional materials of ski construction. It should be particularly noted that the lower, snow contacting surface 10*c* of the head portion 10 of the ski is uninterrupted.

The male connector 21 is fabricated of substantially flat stock material, preferably metal, for partial embedment within the ski. The male connector 21 includes an abutment surface, indicated by the numeral 21*a*, which coterminates with the inward end 11*d* of the tail portion 11 as illustrated in FIG. 3. The rearward end of the male connector 21 includes a taper 21*b*, as illustrated in FIGS. 2 and 4, to follow the conventional contours of a downhill ski which characteristically taper from the thicker section on which the bindings are mounted to the relatively thin section at the tail of the ski.

The male connector 21 may also be provided with threaded holes 21*g* registering with the screw or bolt members 16 used to mount the heel binder 13 to the ski.

Figure 5:
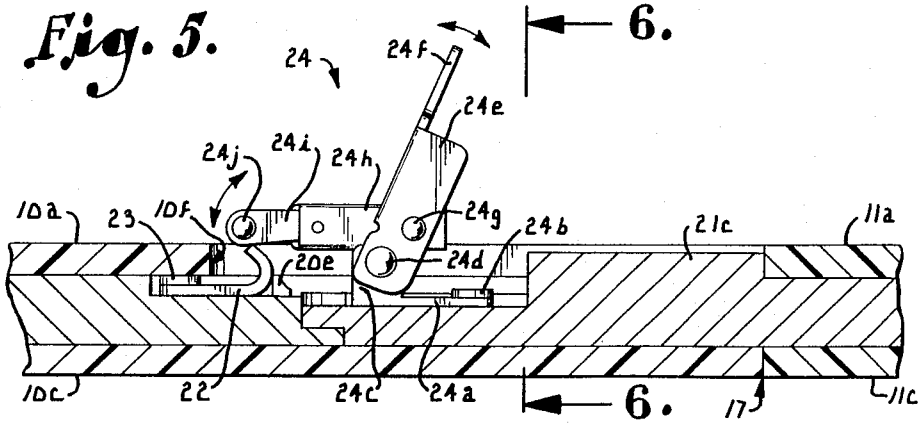
FIG. 5 is an enlarged side, elevational view similar to that of FIG. 4 but showing the lock mechanism in an unlatched position in preparation for separation of the two portions of the ski.

Projecting outwardly from the abutment surface 21*a* of the male connector 21 is an integrally formed tongue 21*c* having an outwardly extending peripheral ridge 21*a* adapted to be matingly received within the continuous channel 20*d* of the female connector 20. Mounted on the forward end of the tongue 21*c*, on the upper surface thereof, is a toggle lock member 24. As best illustrated in FIG. 5, the toggle member 24 includes a base 24*a* secured to the tongue 21*c* of the male connector 21 by threaded fasteners 24*b* and having upstanding ears 24*c*. Pivotally connected to the upstanding ears 24*c* by rivets 24*d* are forwardly projecting arms 24*e* of a release lever interconnected at the rearward ends thereof by a finger release plate 24*f*. A rod 24*g* is mounted on the release lever arms 24*e* intermediate the forward pivot rivets 24*d* and the release plate 24*f*. The rod 24*g* carriers a keeper 24*h* having forwardly projecting arms 24*i* which are interconnected at the forward ends thereof by a retainer bar 24*j*. Thus constructed, the keeper 24*h* has limited pivotal movement with respect to the release lever 24*e* and the release lever 24*e* has limited pivotal movement with respect to the male connector 21 as indicated by the two sets of arrows in FIG. 5. It should be noted that when the release lever 24*e* is in the horizontal position as illustrated in FIG. 4 that the pivot axis 24*g* on which the keeper 24*h* is mounted is lower than the pivot axis 24*d* of the release lever 24*e* whereby an overcenter cam action is achieved.

In operation, the separable ski constructed in accordance with the foregoing principles may be assembled by inserting the tongue 21*c* of the male connector 21 into the socket 20*c* of the female connector 20 until the abutment end 20*a* of the female connector 20 firmly contacts the abutment surface 21*a* of the male connector 21. With particular reference to FIG. 5, the head and tail portions 10 and 11 of the ski may be locked together by rotating the release lever 24*e* forwardly (i.e., to the left in the FIG. 5 view) until the retainer bar 24*j* extends forwardly of the latch hook 22. The keeper 24*h* may then be rotated downwardly so that the retainer bar 24*j* is received within the bight of the latch hook 22. The release lever 24*e* is then rotated to the rear (i.e., to the right in the FIG. 5 view) until disposed in a horizontal position as shown in FIG. 4 to securely lock together the head and tail portions 10 and 11 of the ski. Thus assembled, the ski is ready for use.

It should be noted that the latching mechanism does not project from the normal dimensions of the ski which is to indicate that the mechanism is either slightly recessed below or lies in substantially the same plane as the upper surfaces 10*a* and 11*a* of the head and tail portions 10 and 11 of the ski. The overcenter cam feature of the release lever 24*e* provides secure and positive locking engagement between the two ski pieces.

The interconnecting joint is further strengthened when a ski boot 14 is conventionally held between the toe piece 12 and the heel binder 13 by placing the interconnecting joint in tension (FIG. 4). When so held in the bindings, the ski boot overlies the release lever 24*e* which cannot be moved to a release position until the ski boot 14 is removed from the bindings 12 and 13. Thus, to separate the head and tail portions 10 and 11 of the ski, the ski boot 14 must be removed from the bindings 12 and 13 and the skier may lift the release plate 24*f* of the release lever 24*e* and rotate the lever 24*e* forwardly which causes the retainer bar 24*j* to disengage the bight of the latch hook 22. Skiers will appreciate that under certain skiing conditions, moisture and cold temperatures may tend to bind the interconnecting joint. When such is encountered, the skier need only further rotate the release lever 24*e* forward which causes the forward end of the keeper arms 24*i* adjacent the retainer bar 24*j* to engage the material of construction of the ski at the forwardmost end of the recessed portion in which the latch mechanism resides as indicated by the reference numeral 10*f* in FIG. 5. Further urging of the release lever 24*e* provides mechanical advantage to push the two portions of the ski apart a short distance in order to break the frictional bond of the interconnecting joint. The retainer bar 24*j* of the keeper may then be rotated upwardly and the ski portions may be fully separated.

The interconnecting joint provided by the male and female connectors 20 and 21 may be incorporated during the manufacture of the skis themselves or may be subsequently added. When utilized in the ski manufacturing process, it is contemplated that the rearward portions of the male and female connectors as well as the side edges may be significantly tapered or relieved to facilitate incorporation of the members in the laminating construction of the ski. When an existing, full length ski is to be retrofitted with an interconnecting joint, it is envisioned that the male and female connectors 20 and 21 are preferably constructed in the form as substantially shown in FIG. 2. When the ski is divided intermediate its length thereof, the portions 10 and 11 may be routed out to receive the respective male and female connectors 20 and 21 which may then be adhesively bonded within the cavities of the ski portions 10 and 11.

When the threaded holes 20*g* and 21*g* which receive the threaded fastener members 15 and 16 mounting the ski bindings 12 and 13 to the ski are incorporated in the male and female connectors, a construction of extremely high structural integrity is achieved, capable of withstanding the most rigid ski conditions. Utilizing this feature, the interconnecting joint is influenced by a triple bond provided by the adhesive bond between the male and female connectors with the convention materials of ski construction, the mechanical bond provided by the locking mechanism and threaded members mounting the bindings and a frictional bond placing the entire interconnecting joint in tension when a ski boot is clamped in the bindings.

It should be understood, however, that the threaded holes in the male and female connectors are optional and may alternatively be formed as simply cutouts in the rearward portions of the male and female connectors into which conventional materials of ski construction are received to provide a medium for receiving the screws mounting the ski bindings.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. A separable ski laterally divided intermediate the ends thereof, said ski comprising:

first and second ski portions positionable in longitudinal, end butting fashion, each said ski portion having an upper surface and a lower, skiing surface;

first and second ski boot binders mounted respectively on the upper surface of said first and second ski portions;

a female connector substantially embedded within said first ski portion, said first ski portion including a lower snow engaging surface extending beneath said female connector, said female connector including an open, substantially U-shaped socket having forwardly projecting arms with interior sidewalls and having a continuous grooved channel in said sidewalls;

a male connector substantially embedded within said second ski portion, said second ski portion including a lower snow engaging surface extending beneath said male connector, said male connector having a substantially U-shaped tongue projection extended longitudinally therefrom and configured to matingly engage said female connector when said ski portions are positioned in end abutting fashion, said tongue projection of said male connector including an outwardly projecting continuous ridge thereon received within said continuous grooved channel in said sidewalls of said female connector when said ski portions are positioned in end abutting fashion;

latch hook means secured to said female connector and recessed below the upper surface of said first ski portion; and toggle lock means secured to said male connector to lockingly engage said latch hook means when said male connector engages said female connector, said toggle lock means recessed below the upper surface of said second ski portion when lockingly engaged with said latch hook means and positioned to lie between said first and second ski boot binders.

2. The ski as in claim 1, said toggle lock means including a finger actuatable release lever movable to a release position whereby said toggle lock means disengages said latch hook means and movable to a lock position wherein said finger actuatable release lever is recessed below the upper surface of said ski portions.

3. The ski as in claim 1, said toggle lock means including a retainer adapted to engage said latch hook means and further including an overcenter cam lever biasable to a lock position when said retainer engages said latch hook means.

4. The ski as in claim 1, said male and female connectors being adhesively bonded respectively to said first and second ski portions.

5. The ski as in claim 2, said release lever movable from said lock position to a disconnect position whereby said release lever may be used to mechanically break the frictional bond between said male and female connectors to facilitate separation of the first and second ski portions.

6. An interconnecting joint for joining first and second ski portions, said interconnecting joint comprising:

a female connector embeddable substantially within said first ski portion, said first ski portion including a lower snow engaging surface extending beneath said female connector, said female connector including an open, substantially U-shaped socket having forwardly projecting arms with interior sidewalls and having a continuous grooved channel in said sidewalls;

a male connector embeddable substantially within said second ski portion, said second ski portion including a lower snow engaging surface extending beneath said male connector, said male connector having a substantially U-shaped tongue projection extended longitudinally therefrom and configured to matingly engage said female connector when said ski portions are positioned in end abutting fashion, said tongue projection of said male connector including an outwardly projecting continuous ridge thereon received within said continuous grooved channel in said sidewalls of said female connector;

latch hook means secured to said female connector and recessible below the upper surface of said first ski portion; and toggle lock means secured to said male connector to lockingly engage said latch hook means when said male connector engages said female connector, said toggle lock means recessible below the upper surface of said second ski portion when lockingly engaged with said latch hook means.

7. The joint as in claim 6, said toggle lock means including a finger actuatable release lever movable to a release position whereby said toggle lock means disengages said latch hook means and movable to a lock position wherein said finger actuatable release lever is recessible below the upper surface of said ski portions.

8. The joint as in claim 6, said toggle lock means including a retainer adapted to engage said latch hook means and further including an overcenter cam lever biasable to a lock position when said retainer engages said latch hook means.

9. The joint as in claim 7, said release lever movable from said lock position to a disconnect position whereby said release lever may be used to mechanically break the frictional bond between said male and female connectors to facilitate separation of the first and second ski portions.

* * * * *